US005433480A

United States Patent [19]

Gresham et al.

[11] Patent Number: 5,433,480

[45] Date of Patent: Jul. 18, 1995

[54] NOTEBOOK BINDER SYSTEM

[75] Inventors: David M. Gresham; John W. Davison, both of Columbus, Ohio; Robert D. Soto, Chicago, Ill.; Chris Cicenas, Columbus, Ohio

[73] Assignee: Morningstar Financial, Chicago, Ill.

[21] Appl. No.: 66,490

[22] Filed: May 24, 1993

[51] Int. Cl.[6] ..... B42D 3/04

[52] U.S. Cl. ..... 281/17; 281/16; 281/45; 402/21; 402/19

[58] Field of Search ..... 281/151, 16, 17, 45; 402/19, 21, 23, 60

[56] References Cited

U.S. PATENT DOCUMENTS

| | | | |
|---|---|---|---|
| 642,244 | 1/1900 | Morehouse . | |
| 3,353,844 | 11/1967 | Staats | 281/17 |
| 3,752,503 | 8/1973 | Holes et al. . | |
| 3,768,838 | 10/1973 | Shibata . | |
| 3,909,141 | 9/1975 | Staats . | |
| 4,113,394 | 9/1978 | Giulie . | |
| 4,307,972 | 12/1981 | Errichielle . | |
| 4,420,086 | 12/1983 | Bardes . | |
| 4,445,710 | 5/1984 | Borel . | |
| 4,682,792 | 7/1987 | Simmons . | |
| 4,934,738 | 6/1990 | Colonna . | |
| 5,018,895 | 5/1991 | Meier, Jr. . | |
| 5,104,147 | 4/1992 | King . | |

FOREIGN PATENT DOCUMENTS

| | | | |
|---|---|---|---|
| 948166 | 1/1964 | United Kingdom | 281/17 |
| WO904523 | 5/1990 | WIPO . | |

*Primary Examiner*—Willmon Fridie

*Attorney, Agent, or Firm*—Laff, Whitesel, Conte & Saret

[57] ABSTRACT

A system for releasably and laterally mounting or removing a plurality of booklets including in a preferred embodiment: 1) unitary spines for removably retaining the booklets therein each having at least one upstanding tab on an outer surface thereof and, 2) a binder for releasably mounting the unitary spines therein, the binder having a plurality of longitudinally extending channels that are spaced apart and parallel to one another and have a ridge for engaging the upstanding tabs on the unitary spines during mounting and removal of the unitary spines in the binder.

21 Claims, 7 Drawing Sheets

NOTEBOOK BINDER SYSTEM

FIELD OF THE INVENTION

This invention relates to notebook binders. More particularly, this invention relates to notebook binder systems in which multiple-page documents can be conveniently mounted and removed.

BACKGROUND OF THE INVENTION

Many enterprises transmit information periodically through trade publications, reports, brochures, booklets, or other similar multiple page documents. For example, financial reporting services periodically generate reports that trace the growth and analyze trends of selected stocks, bonds and mutual funds. These financial reports are typically repeatedly examined over a period of time and therefore must be set aside or stored so that they may be conveniently located when needed and replaced when updated reports become available.

Some of tile more innovative enterprises accommodate their subscribers by providing them with notebook binders for storing the reports for future use. In most instances, the binders are three-ring notebook binders.

Although three-ring notebook binders provide a means for storing such documents, there are certain disadvantages associated with their use. For example, three-ring binders require constant opening and closing of the binder rings and shifting of the binder contents over the binder rings whenever old materials are to be replaced. Another problem with three-ring notebook binders is that the binder rings are often difficult to open and close, oftentimes pinching the user's fingers.

Yet another problem with three-ring notebook binders is that booklets or other multiple-paged documents are often difficult to turn within the binders or are prone to snagging or catching on the binder rings. Furthermore, three-ring notebook binders often cause multiple-paged documents to become skewed on the binder rings which interferes with the opening of the document. Additionally, three-ring notebook binders prevent multiple-paged documents from lying flat because the binder rings interfere with the holes in the document. Finally, the binder rings often create loud noises when opened and closed.

Accordingly, an object of the present invention is to provide a notebook binder system for releasably and laterally mounting a plurality of multiple-page documents, referred to generally below as "booklets", that is easy to use and that eliminates the necessity of opening and closing the binder to remove and insert material.

Another object of the present invention is to provide a notebook binder system for releasably and laterally mounting a plurality of bound booklets.

Another object of the present invention is to provide a compact and efficient notebook binder system for releasably mounting a plurality of booklets.

Another object of the present invention is to provide a notebook binder system for releasably mounting a plurality of booklets in such a manner that they resemble a large, unitary book.

A further object of the present invention is to provide a notebook binder system for releasably mounting a plurality of booklets that do not skew in the binder and lie flat when opened.

Yet another object of the present invention is to provide a notebook binder system for releasably and laterally mounting a plurality of booklets that is practical to use and relatively inexpensive to manufacture.

Other objects and advantages of the invention will appear hereinafter.

SUMMARY OF THE INVENTION

The present invention, in a preferred embodiment, accomplishes the foregoing objects by providing a notebook binder system for releasably retaining a plurality of laterally inserted booklets comprising a plurality of unitary spines each for removably retaining the booklets therein and a notebook binder having means for releasably mounting the unitary spines. A front and back cover are attached to the binder for covering and protecting the booklets in the binder.

In a preferred embodiment, the unitary spines each include a bottom member and a top member that are flexibly connected to one another by a living hinge. Booklet fastening means are preferably upstanding projections located on the bottom member for removably retaining the booklets to the unitary spines. Alternatively, booklet fastening means that correspond to and coact with one another are located on both the bottom and top members for removably fastening the members to each other and to the booklets. The booklet fastening means extend through a plurality of perforations along an upper edge of the booklets.

The bottom and top members also each include at least one first fastening means on an outer surface thereof. In the preferred embodiment, the first fastening means are upstanding tabs which are centrally located on the top member and adjacent each of the ends on the bottom member. In an alternative embodiment, the first fastening means may comprise other fasteners such as magnets or Velcro®. In all embodiments, the first fastening means are used to removably mount the unitary spines in the notebook binder, as explained in greater detail below.

The corners of the bottom and top members adjacent the living hinge may be rounded for easing the insertion of the unitary spines into the binder during the mounting process.

The binder, in the preferred embodiment, includes a plurality of longitudinally extending channels that are evenly spaced apart and parallel to one another. The channels are individually defined by a first and a second parallel wall extending the length thereof and include a second fastening means on an inner surface thereof. The second fastening means in the preferred embodiment are integrally formed ridges that longitudinally extend along the inner surfaces of the first and second parallel walls. Alternatively, the walls each include at least one integrally formed boss which projects outwardly from the inner surface thereof. In this alternate embodiment, the first parallel wall preferably includes at least one boss adjacent each of its ends, while the second parallel wall preferably includes a centrally located boss. In other embodiments, the first and second fastening means include Velcro® hook and loop tapes or magnetic fastening means.

The binder may include only a single channel or other means for releasably mounting the unitary spines. However, in a preferred embodiment, there are at least ten channels in the binder.

In use, first fastening means laterally and forcibly engage second fastening means. Specifically, the first fastening means on the unitary spines engage the second fastening means as the spines are laterally inserted into the binder with respect to the binder channels. As the fastening means engage one another, the unitary spines experience two simultaneous flexures which allow for their lateral insertion. First, the bottom and top members of the unitary spines move inwardly towards one another which closes the unitary spines more tightly and causes the spines to function as spring clips when inserted into the binder channels. Second, the pressure exerted on the first fastening means results in flexing of the spines along their lengths.

The notebook binder includes a front and a back cover which may be rotatably mounted. The inside surface of each cover may include a pocket for holding additional materials.

The above, as well as other objects and advantages of the invention, will become apparent from the following detailed description of the preferred embodiments, reference being made to the accompanying drawings.

DETAILED DESCRIPTION OF THE INVENTION

Figure 1:
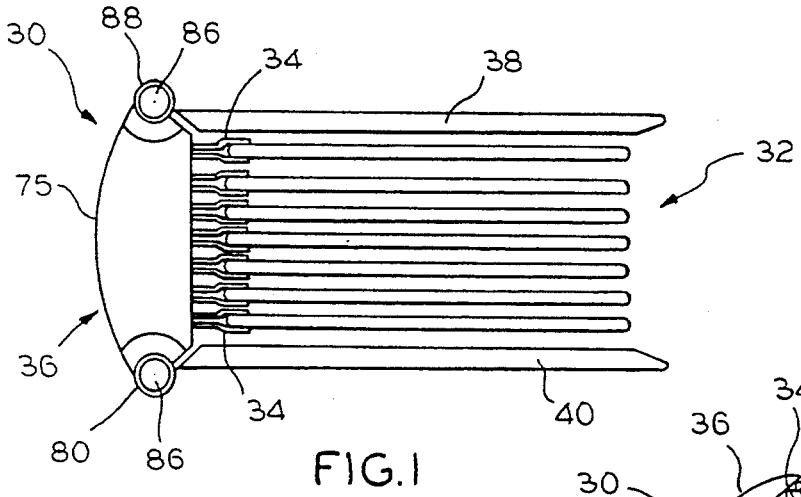
FIG. 1 is an end view of the preferred embodiment of the inventive notebook binder assembly.
Figure 2:
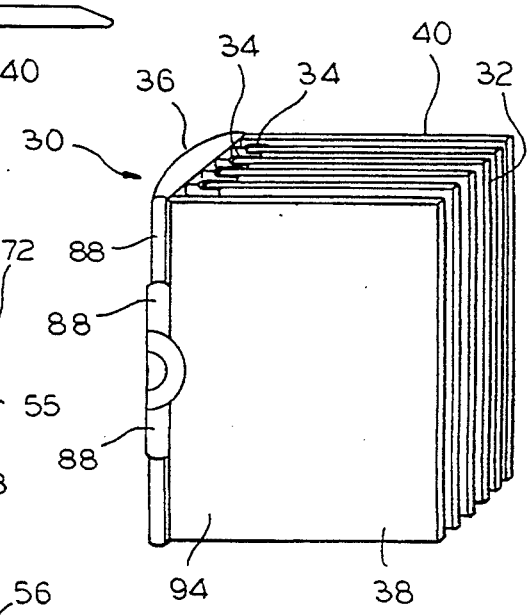
FIG. 2 is a perspective view of the notebook binder assembly of FIG. 1.

Generally referring to FIGS. 1 and 2, the invention provides an assembly, denoted by the numeral 30, for releasably and laterally mounting a plurality of booklets 32 into a notebook binder having, in part, a plurality of unitary spines 34 for removably retaining booklets 32 and a binder 36 for releasably mounting unitary spines 34 into the notebook. A front cover 38 and a back cover 40 are pivotally attached to binder 36 for covering and protecting the booklets. The booklets are bound along one edge.

As shown in FIGS. 3–6, unitary spines 34 are generally elongated with a bottom member 42 and a top member 44, each of which includes an inner surface 46, an outer surface 48, an inner edge 50, and an outer edge 52. Bottom member 42 and top member 44 are integrally and pivotally connected to one another along their inner edges by a living hinge 54. Bottom member 42 and top member 44 are each inwardly stepped (as indicated by numeral 55) towards living hinge 54. Both the bottom and top member preferably include rounded corners 56 adjacent inner edge 50 to facilitate insertion of the unitary spines into the binder. Additionally, the members may include rounded corners 58 adjacent outer edge 52.

Figure 5:
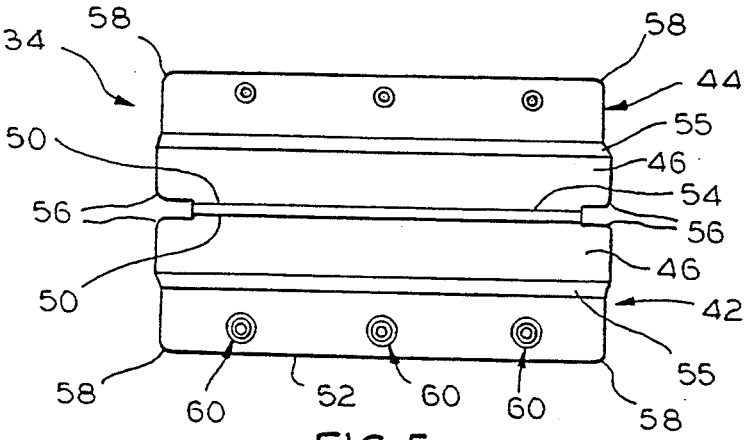
FIG. 5 is a plan view of the outer surface of the bottom and top members of the unitary spine of FIG. 2.
Figure 7:
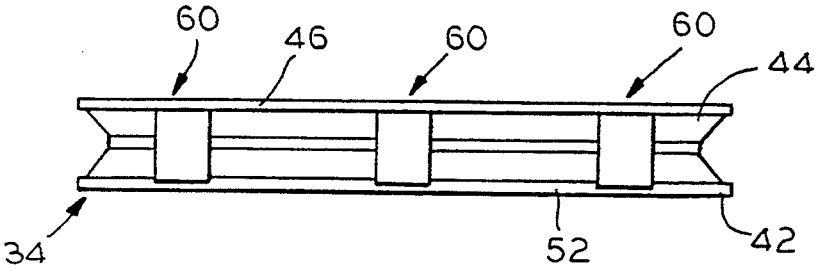
FIG. 7 is a side view of the outer edge of the unitary spine of FIGS. 3–6, illustrating its appearance subsequent to folding along the living hinge.
Figure 8:
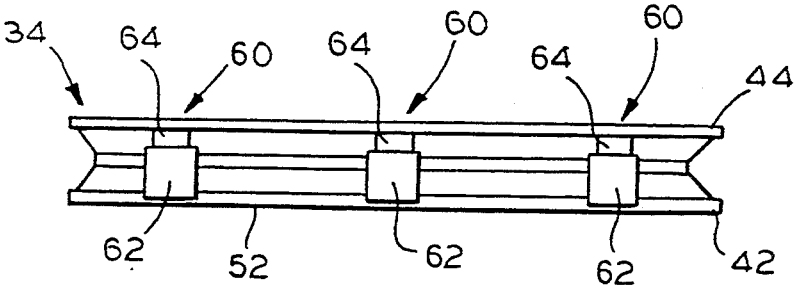
FIG. 8 is a side view of another embodiment of the unitary spine.
Figure 9:
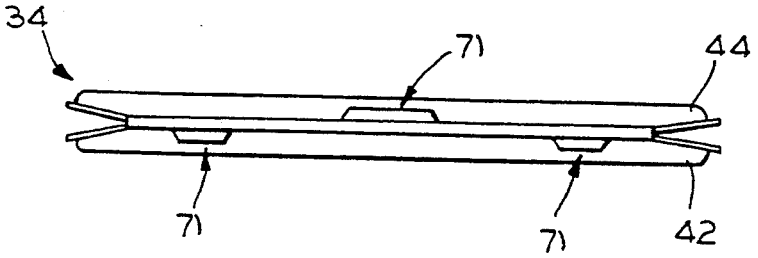
FIG. 9 is a side view of the inner edge of the unitary spine of FIGS. 3–6, illustrating its appearance subsequent to folding along the living hinge.

A plurality of booklet fastening means 60 are preferably located on inner surface 46 of bottom member 42 adjacent outer edge 52 for removably fastening the booklets to the unitary spines (see FIGS. 5, 7). Booklet fastening means 60 are preferably upstanding projections. Booklet fastening means 60 may alternatively be located on inner surface 46 of both bottom member 42 and top member 44 for removably fastening the members to each other and to the booklets (FIG. 8). Such booklet fastening means include a plurality of larger projections 62 on the bottom member that lockingly engages a plurality of corresponding smaller projections 64 on the top member.

Figure 3:
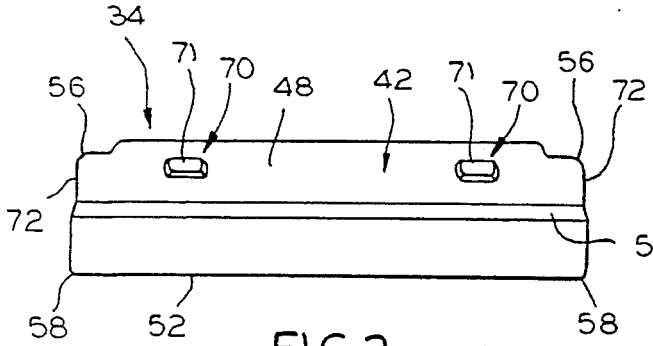
FIG. 3 is a side view of the bottom member of the unitary spine of FIG. 2.
Figure 4:
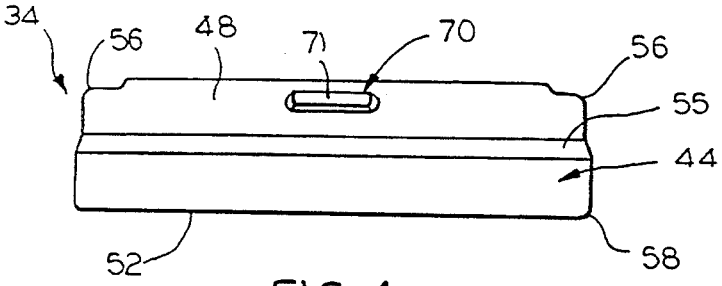
FIG. 4 is a side view of the top member of the unitary spine of FIG. 3.
Figure 6:
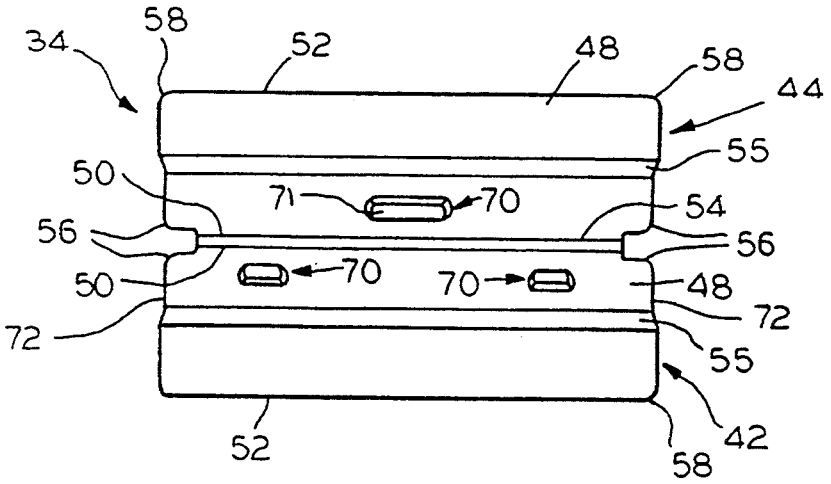
FIG. 6 is a plan view of the inner surface of the bottom and top members of the unitary spine of FIG. 5.
Figure 10:
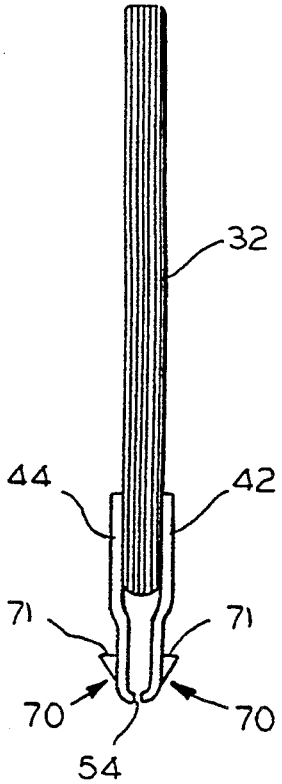
FIG. 10 is a bottom view of the unitary spine with a mounted booklet.
Figure 22:
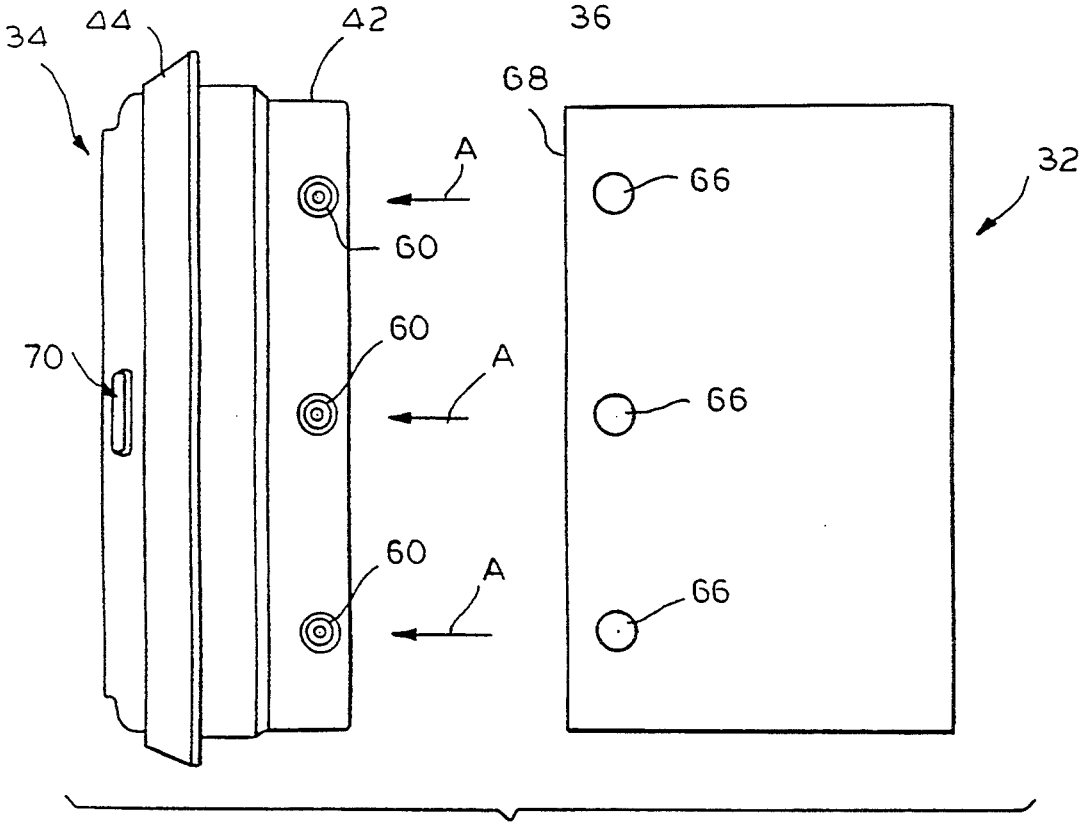
FIG. 22 is a perspective view of the unitary spine and booklet of FIG. 10, illustrating the insertion of the booklet into the spine.

The booklet fastening means in either of the above-described embodiments extend through a plurality of perforations 66 adjacent an top edge 68 of booklets 32 (see FIG. 22). In addition to ;booklet fastening means 60, the bottom and top members each include at least one first fastening means 70 on outer surface 48 for forcibly engaging binder 36 during the mounting and removal of unitary spines 34 (see FIGS. 3–4, 6, and 9–10). In the preferred embodiment, top member 44 includes a centrally located upstanding tab 71 (FIGS. 4 and 6). Likewise, bottom member 42 includes at least one upstanding tab 71 adjacent each of its ends 72 (FIGS. 3 and 6). The centrally located tab on the top member is preferably larger, particularly in its length, than the tabs adjacent the ends of the bottom member. Both the centrally located tab and the two adjacent tabs are preferably tapered towards living hinge 54 (see FIG. 10). In alternate embodiments, first fastening means 70 is a magnetic or metallic strip 73 and/or a strip of Velcro® hook and loop tape 75 (See FIG. 26).

Figure 11:
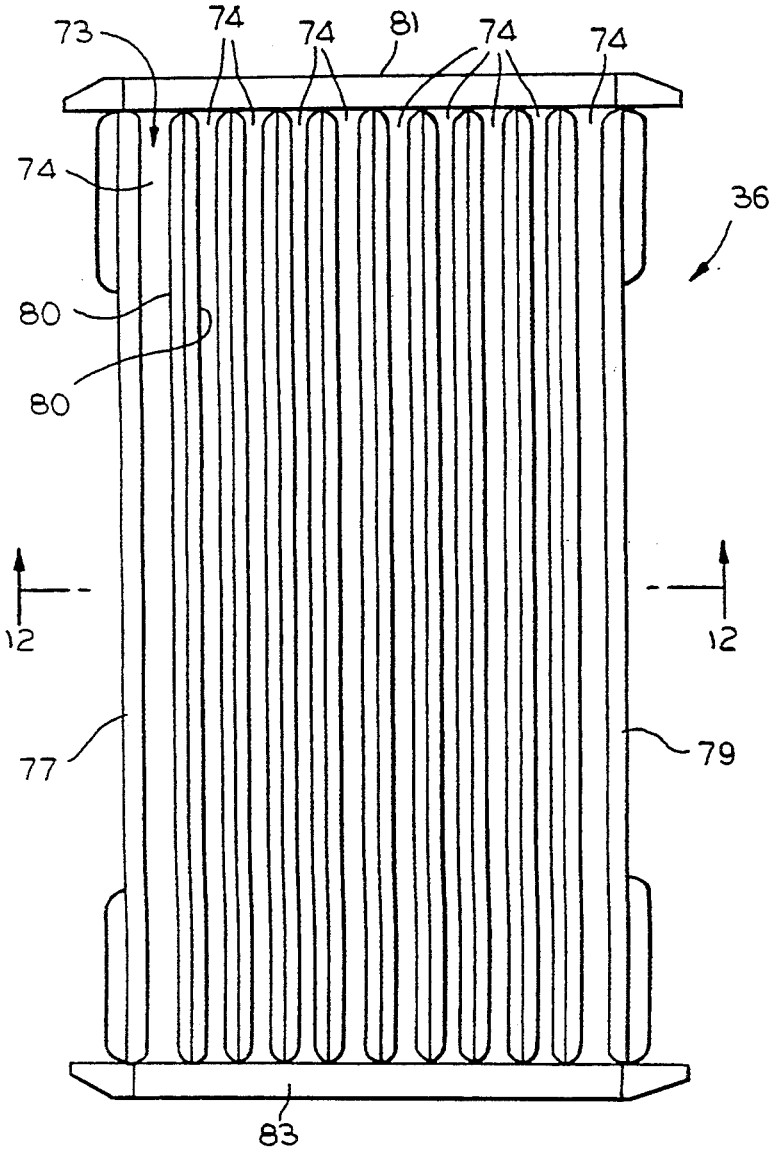
FIG. 11 is a plan view of the surface of the binder of FIGS. 1 and 2.
Figure 13:
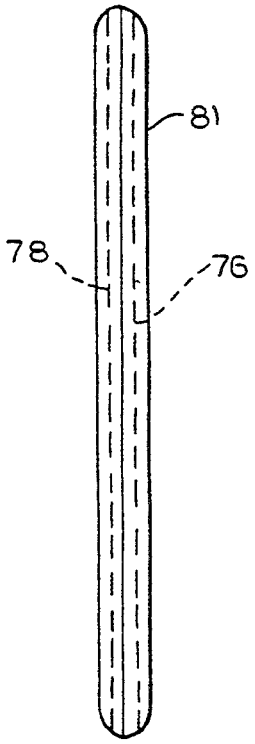
FIG. 13 is a plan view of the first and second parallel walls of the channel of the binder of FIG. 11.
Figure 12:
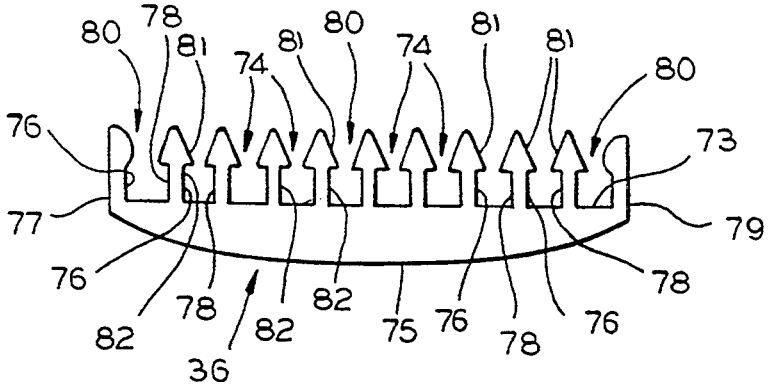
FIG. 12 is a cross-sectional view of the binder, taken along lines 12—12 of FIG. 11.
Figure 14:
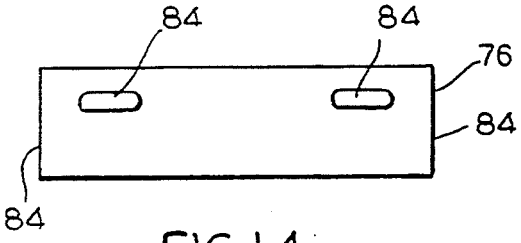
FIG. 14 is a side view of another embodiment of the first parallel wall.
Figure 15:
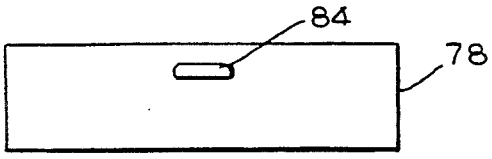
FIG. 15 is a side view of the second parallel wall of the embodiment of FIG. 14.
Figure 16:
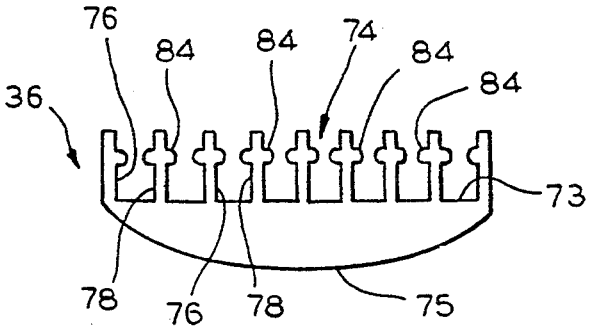
FIG. 16 is a cross-sectional view of the embodiment of FIGS. 14 and 15, illustrating the appearance of the walls in a binder.
Figure 17:
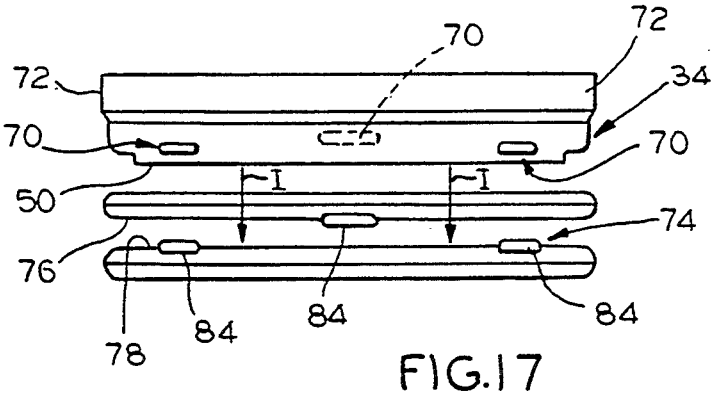
FIG. 17 is a partial perspective view of the binder of FIG. 16, illustrating the insertion of the unitary spine and booklet into the binder channels.
Figure 26:
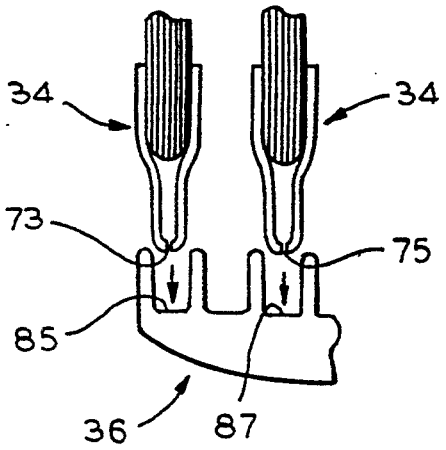
FIG. 26 is a partial cross-sectional view of yet another embodiment of two unitary spines and the binder.

Binder 36 of assembly 30 is elongated and generally rectangular in shape and includes a top surface 73, a bottom surface 75, a first and second side 77, 79, and a top and bottom portion 81, 83, respectively (see FIGS. 1 and 11). A plurality of channels 74 longitudinally extend over top surface 73 from top portion 81 to bottom portion 83 of binder 36. Channels 74 are evenly spaced apart and parallel to one another and are individually defined by first and second parallel walls, 76 and 78, respectively, which extend the length of the channels (FIG. 12). Walls 76 and 78 each include at least one second fastening means go on an inner surface 82 thereof (FIGS. 12–13 and 26). In the preferred embodiment second fastening means 80 is an integrally formed ridge 81 that longitudinally extends along inner surface 82 (See FIGS. 12–13). Alternatively, however, walls 76 and 78 each include at least one integrally formed and boss 84 that projects outwardly from inner surface 82 of the walls (FIGS. 14–17). In the alternate embodiment, first wall 76 includes a boss adjacent each of its ends 84 which corresponds to the location of upstanding tabs 70 on the bottom member. Likewise, second wall 78 includes a centrally located boss which also corresponds to the location of the upstanding tab 70 on the top member. However, the bosses may be positioned at other various locations along the walls as long as they correspond to the location of the upstanding tabs on the top and bottom members (FIG. 17).

In other alternate embodiments, second fastening means 80 include a magnetic or metallic strip 85 and/or a strip of Velcro® hook or loop tape 87 (See FIG. 26). The location of these fastening means must correspond to the location of the first fastening means on the unitary spines and cooperate therewith (magnet to metal or hook to loop). Indeed, while shown along the most lateral edge of the unitary spines and the bottom of the channels, when magnetic/metallic strips or Velcro® hook and loop tapes are used, they may also be located on the outer walls of the unitary spines and the corresponding walls of the channels.

Both resilient ridge 81 (FIGS. 18–20) and resilient boss 84 (FIG. 17) of the various embodiments are forcibly engaged by upstanding tabs 70 on top and bottom members, 42 and 44, respectively, during the mounting and removal of the unitary spines in the binder, which is discussed in greater detail below.

Figure 23:
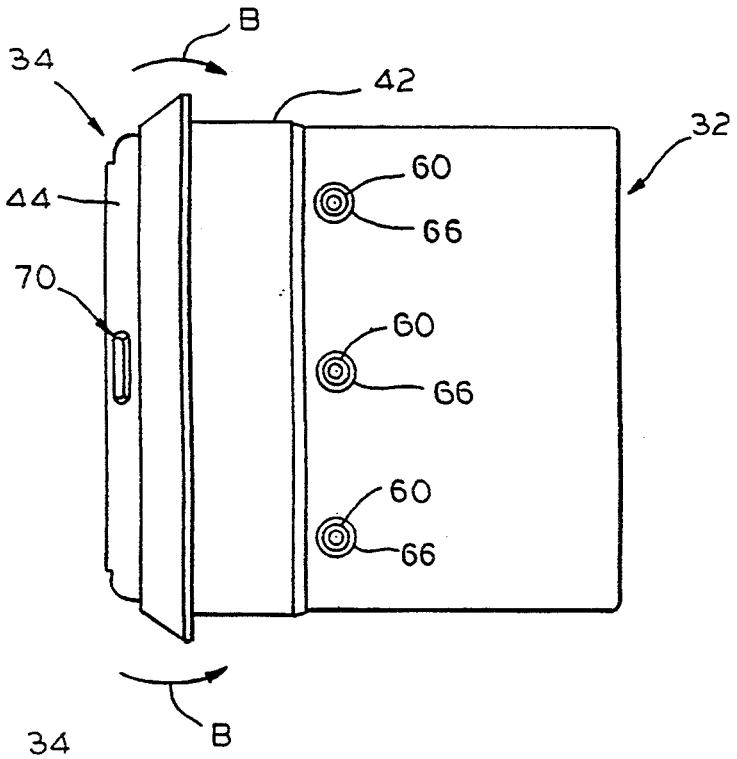
FIG. 23 is a perspective view of the unitary spine and booklet of FIG. 22, illustrating the positioning of the booklet onto the booklet fastening means.
Figure 24:
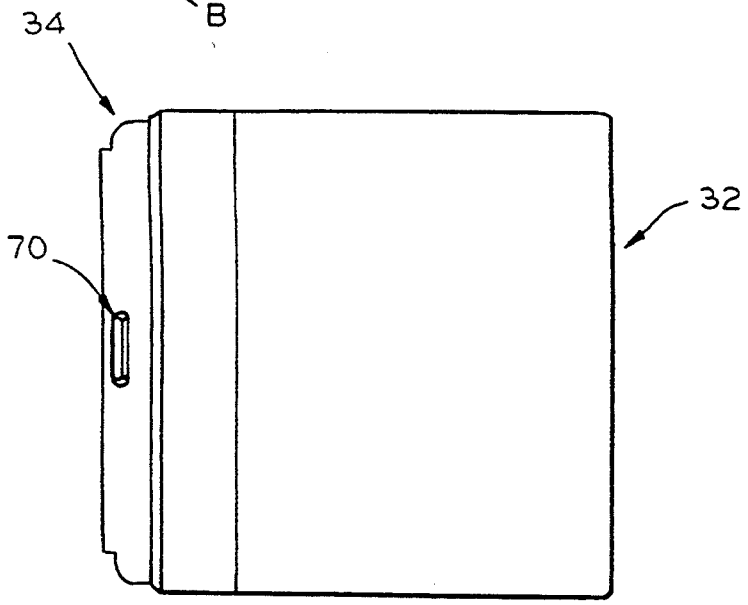
FIG. 24 is a plan view of the unitary spine and booklet of FIG. 23.

As depicted in FIGS. 18–19, 22–24 and 27–29 in use top edge 68 of booklet 32 is inserted into and between bottom member 42 and top member 44 of unitary spines 34, as specifically indicated by arrows A in FIG. 22. Perforations 66 of booklet 32 are aligned with and engaged by booklet fastening means 60 of bottom member 42 of the unitary spines. Booklets 32 are then removably secured within unitary spines 34 by folding together bottom member 42 and top member 44 along living hinge 50, in the direction indicated by arrows B in FIG. 23. In the preferred embodiment, folding the members together causes booklet fastening means 60 of bottom member 42 to press firmly against inner surface 46 of top member 44 (FIGS. 7, 23). In the alternate embodiment, folding the members together causes the larger projections on the bottom member to lockingly engage the smaller projections on the top member for removably fastening the members to each another and to the booklets (FIG. 8).

Figure 18:
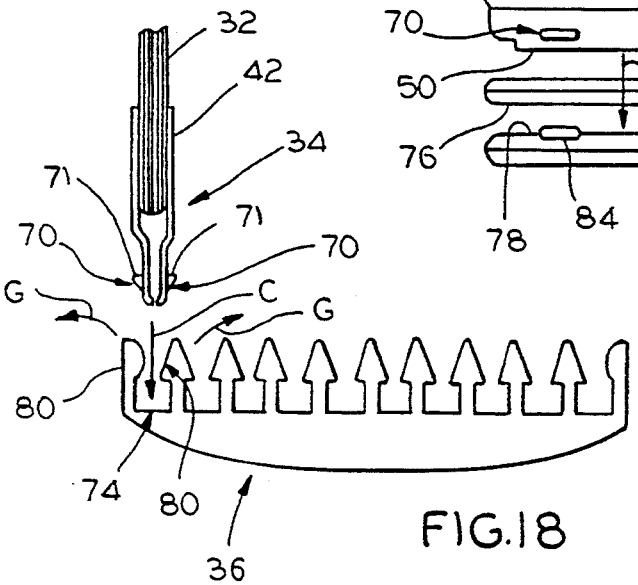
FIG. 18 is a partial cross-sectional view of the binder of FIG. 11, illustrating the insertion in an alternate embodiment of the unitary spine and booklet into the binder channel.
Figure 27:
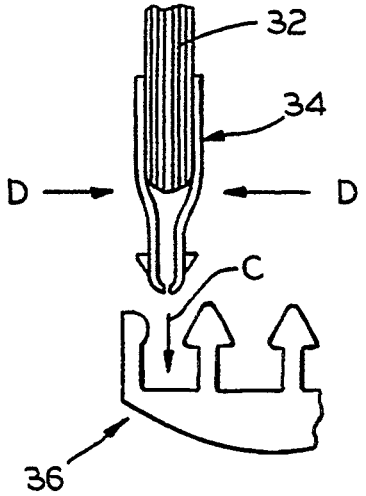
FIG. 27 is a partial cross-sectional view of the binder of FIG. 11, illustrating the preferred insertion of the unitary spine and booklet into a binder channel.
Figure 28:
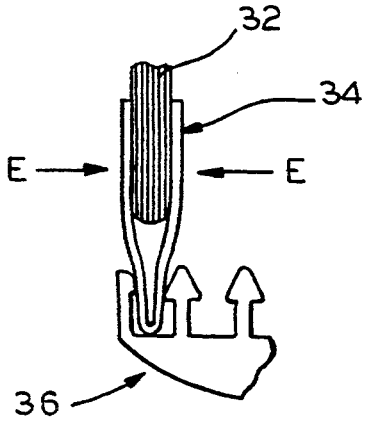
FIG. 28 is a partial cross-sectional view of the binder of FIG. 11, illustrating the preferred appearance of the unitary spine and the booklet subsequent to insertion into a binder channel.
Figure 29:
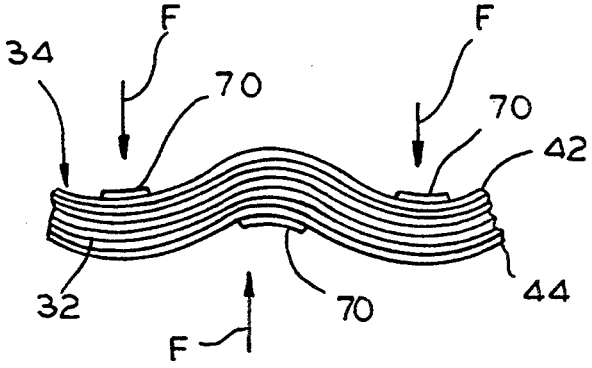
FIG. 29 is an exaggerated plan view of the unitary spine and booklet of FIG. 28, illustrating the flexure of the spine during insertion into a binder channel.

Next, the folded spines and inserted booklets 32 (FIG. 24) are laterally mounted into the binder with respect to the binder channels by individually inserting unitary spines 34 into channels 74, as indicated by arrow C in FIGS. 18 and 27. As unitary spines 34 are inserted into channels 74, first fastening means 70 on outer surfaces 48 of unitary spines 34 forcibly and laterally engage second fastening means 80 on first and second parallel walls, 76 and 78, respectively. As the fastening means engage one another, the unitary spines experience two simultaneous flexures which allow for their lateral insertion (FIGS. 27–29). The first flexure occurs when bottom and top members, 42 and 44, respectively, of unitary spines 34 pivot on living hinge 50 and move inwardly toward one another (FIG. 27), causing unitary spines 34 to close more tightly around booklet 32 (FIG. 28), as indicated by arrows D and E in the figures. This first flexure causes the unitary spines to function as spring clips when inserted into the binder channels. The second flexure occurs when unitary spines 34 become distorted into a "S-like" configuration as pressure is exerted on first fastening means 70, as indicated by arrows F and exaggerated in FIG. 29. This second flexure results in dual flexing: one, the center of the spines are flexed in one direction while, two, the ends of the spines are flexed in an opposite direction. This distortion primarily occurs as a result of the slight rocking may produce a wiggling motion during the lateral insertion of the spines into the binder channels.

Figure 19:
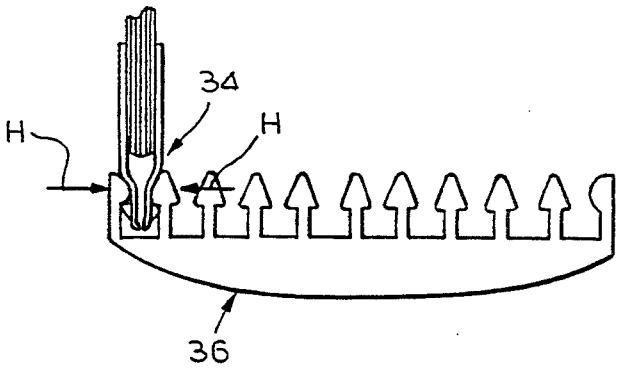
FIG. 19 is a partial cross-section of the binder of FIG. 11, illustrating the appearance in an alternate embodiment of the unitary spine and the booklet subsequent to insertion into the binder channel.
Figure 20:
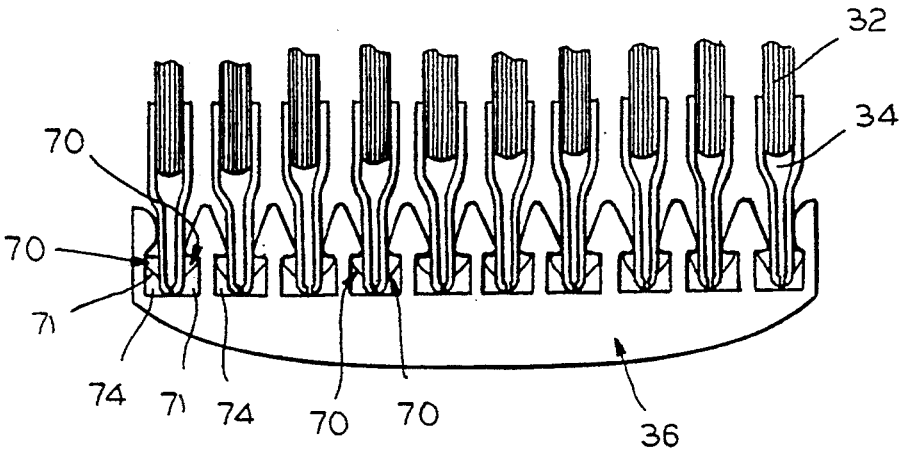
FIG. 20 is a partial cross-section of the binder of FIG. 11, illustrating the appearance in an alternate embodiment of the binder subsequent to the insertion of the unitary spines.

Although unitary spines 34 provide preferably most, if not all, of the flexure required for the lateral insertion of the spines into the binder channels, in an alternate embodiment first and second parallel walls, 76 and 78, respectively may flex during insertion of the spines, as shown in FIG. 18. Specifically, as first fastening means 70 laterally engage second fastening means 80, the parallel walls are outwardly deflected, as indicated by arrows G in FIG. 18. As the parallel walls are outwardly deflected, first fastening means 70 pass under and are held in place by second fastening means 80, whereupon the parallel walls spring back to their original upright position, as shown in FIGS. 19 and 20. Subsequently, second fastening means 80 on the parallel walls creates pressure on outer surfaces 48 of unitary spines 34 to additionally secure the booklets within the unitary spines, as indicated by arrows H in FIG. 19.

In the preferred embodiment, the first fastening means 70 are upstanding tabs 70, the second fastening means are ridges 81, and the mounting process if identical to that as described above. In the alternate embodiment, unitary spines 34 are mounted in a manner similar to that described above except that upstanding tabs 71 on outer surfaces 48 of unitary spines 34 forcibly engage bosses 84 by downwardly deflecting and passing under the bosses where they are securely held in place. As shown by arrows I in FIG. 17, the bosses on parallel walls 76 and 78 of channels 74 are aligned with upstanding tabs 71 on the bottom and top members of the unitary spines.

Figure 21:
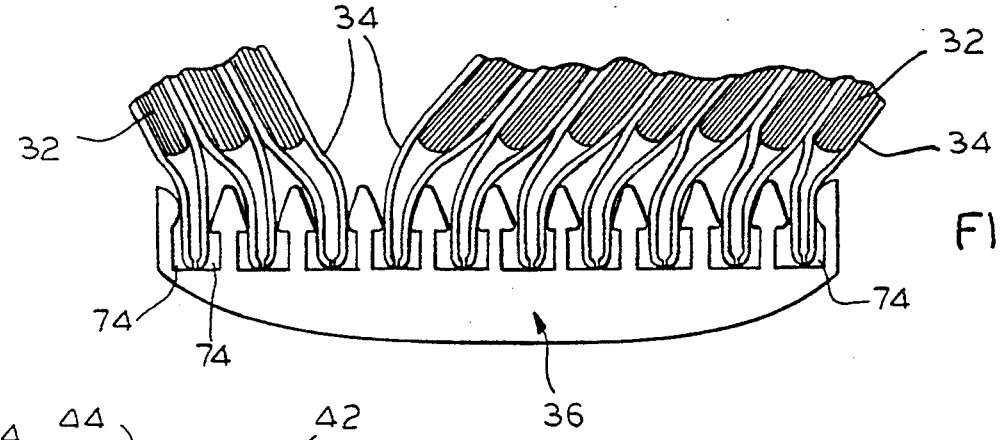
FIG. 21 is a partial cross-section of the binder of FIG. 20, illustrating the appearance of the booklets in an open position.

As shown in FIG. 21, unitary spines 34 are completely flexible within channels 74 to enable full exposure of the surface area of each booklet during viewing. Moreover, the insertion of unitary spines 34 into channels 74 infringes only slightly upon the margin of booklet 32 that is bound and adjacent its upper edge 68. Therefore, the positioning of unitary spines 34 on booklets 32 does not interfere with or obstruct the pages in the booklets.

The removal of unitary spines 34 from binder 36 in the previous embodiments involves reversing the above-described mounting process. Specifically, and in the preferred embodiment, as unitary spines 34 are pulled out and away from channels 74, the bottom and top members of the spines spring apart while the spines flex at different points along their lengths. Likewise, in the alternate embodiment, as the unitary spines are pulled out and away from the channels, the first means to upwardly deflect and pass the second fastening means 80.

Figure 25:
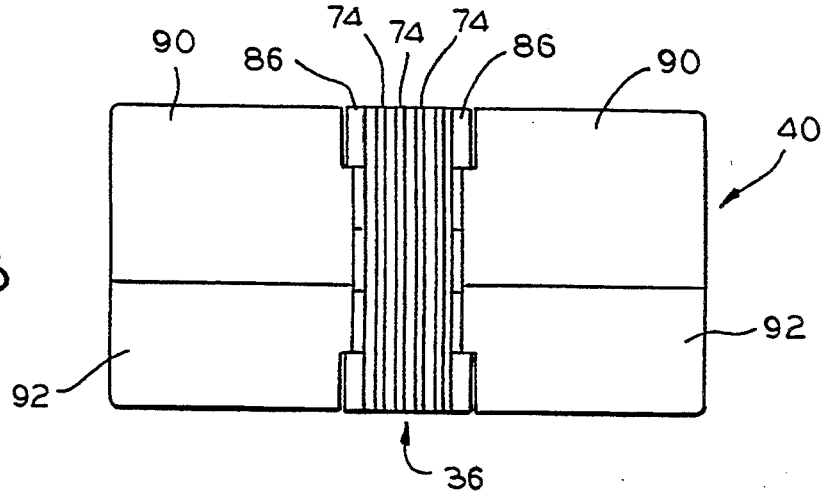
FIG. 25 is a plan view of the binder and front and back covers of the assembly of FIG. 2, illustrating the covers in an open position.

FIGS. 1–2 and 25 show assembly 30, including front cover 38, back cover 40, and binder 36. As shown in FIGS. 1 and 25, the front and back covers are pivotally mounted to binder 36 by a pin 86 which extends through cylindrical channels 88 which are integrally formed with the front and back covers and the binder. FIG. 25 further shows that the inside 90 of the front and back covers includes a pocket 92 for holding supplemental booklets or other materials. Likewise, the outside 94 of the front and back covers include a semicylindrical depression 96 adjacent the binder 36 (FIG. 2).

Binder 36, front cover 38, and back cover 40 of assembly 30 are made by injection molding. Unitary spines 34 may be made by injection molding or any other molding process.

The material from which binder 36, front cover 38, and back cover 40 of assembly 30 are constructed is preferably polyethylene but may alternatively be any lightweight material. Likewise, unitary spines 34 are preferably made from any appropriate resilient material. Moreover, assembly 30 has not been described in terms of approximate measurements, as it should be understood that the dimensions of the assembly may vary according to the nature and size of the booklets or other materials that are releasably mounted therein.

Figure 30:
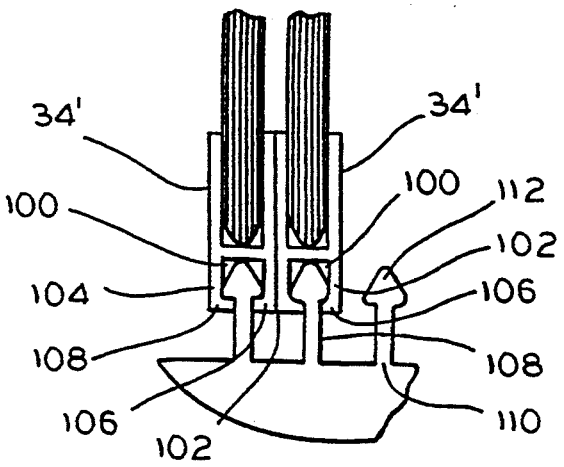
FIG. 30 is a partial cross-sectional view of another embodiment of the invention illustrating two unitary spines mounted to the notebook binder.

Finally, as illustrated in FIG. 30, the relative positions of the first and second fastening means may be reversed. That is, for example, unitary spine 34' may include channels 100 defined by walls 102 and 104 having at least one fastening means on an inner surface thereof in the form, for example, of ridges 106 and 108. In this embodiment, upstanding members 110 having beads 112 are provided in the binder to engage channels 100.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the scope and spirit of the invention.

The invention claimed is:

1. A notebook binder system permitting at least one multi-page booklet to be laterally inserted and removed therefrom comprising:

a unitary spine for removably retaining the booklet therein, said unitary spine having a bottom member that is flexibly connected to a top member, said bottom member and said top member each having a first fastening means on an outer surface thereof; and a binder for releasably mounting said unitary spine therein, said binder having second fastening means adapted to laterally accept said first fastening means on said unitary spine during mounting and removal of said unitary spine in said binder.

2. The system of claim 1 wherein said bottom member and said top member are flexibly connected by a living hinge.

3. The system of claim 1 wherein said bottom member of said unitary spine includes at least one booklet fastening means on an inner surface thereof for removably fastening the booklet to said unitary spine.

4. The system of claim 3 wherein said booklet fastening means are upstanding projections.

5. The system of claim 3 wherein the booklet includes a plurality of perforations along an upper edge through which extend said booklet fastening means on said inner surface of said bottom member.

6. The system of claim 1 wherein said bottom member and said top member of said unitary spine include corresponding fastening means that coact with one another to removably fasten said members to each other and to the booklet.

7. The system of claim 6 wherein said fastening means include a plurality of projections on said bottom member that engage a plurality of corresponding smaller projections on said top member.

8. The system of claim 1 wherein said first fastening means comprise at least one upstanding tab and said second fastening means comprise at least one longitudinally extending channel with at least one integrally formed boss projecting from an inner surface thereof for engaging said tab when said unitary spine is inserted into said notebook binder.

9. The system of claim 8 wherein at least one upstanding tab is located adjacent each end of said bottom member and at least one boss is located adjacent each end of said channels, said upstanding tab and said boss being arranged to engage one another when the multi-page booklet is mounted in said notebook binder system.

10. The system of claim 8 wherein at least one upstanding tab is centrally located on said top member and at least one boss is centrally located in said channel, said upstanding tab and said boss being aligned with one another when the multi-page booklet is mounted in the notebook binder system.

11. The system of claim 1 wherein said binder includes a plurality of longitudinally extending channels that are spaced apart and parallel to one another.

12. The system of claim 1 wherein said first fastening means comprise longitudinally extending channel in said unitary spine opening away from said booklet and having at least one integrally formed boss projecting from an inner surface thereof and said second fastening means comprise at least one upstanding member for engaging said boss.

13. The system of claim 1 wherein said first and second fastening means are a hook and loop tape.

14. The system of claim 1 wherein said first and second fastening means are magnetic.

15. A system for laterally mounting and removing a plurality of booklets comprising:

a plurality of unitary spines for removably retaining the booklets therein, said unitary spines each having a bottom member that is flexibly connected to a top member, said bottom member and said top member each having at least one upstanding tab on an outer surface thereof; and a binder for releasably mounting said unitary spines therein, said binder having a plurality of longitudinally extending channels that are spaced apart and parallel to one another, said channels being individually defined by a first and a second parallel wall and each including an integrally formed ridge longitudinally extending along an inner surface of both said first and second parallel walls, said ridge being adapted to laterally accept said upstanding tab on said unitary spine during mounting and removal of said unitary spines in said binder.

16. The system of claim 15 wherein said bottom member and said top member are flexibly connected by a living hinge.

17. The system of claim 15 wherein said upstanding tab on said top member is centrally located.

18. The system of claim 15 wherein said bottom member includes at least one upstanding tab adjacent each of its ends.

19. The system of claim 15 wherein the lateral acceptance of said upstanding tab by said ridge simultaneously causes said bottom and top members of said unitary spines to move inwardly towards one another while simultaneously flexing at different points along their lengths.

20. A notebook binder for releasably retaining a plurality of laterally inserted booklets comprising:

a plurality of unitary spines for removably retaining the booklets therein, said unitary spines each having a bottom member that is flexibly connected to a top member, said bottom member and said top member each having a first fastening means on an outer surface thereof; and a binder for releasably mounting said unitary spines therein, said binder having a plurality of longitudinally extending channels that are spaced apart and parallel to one another, said channels being individually defined by a first and a second parallel wall and each including a second fastening means on an inner surface of both said first and second parallel walls, said second fastening means being adapted to laterally accept said first fastening means on said unitary spines during mounting and removal of said unitary spines in said binder.

21. The system of claim 20 wherein the lateral acceptance of said first fastening means by said second fastening means causes said bottom and top members of said unitary spines to move towards one another while simultaneously flexing at different points along their lengths.

* * * * *